United States Patent [19]

Cellitti et al.

[11] 4,373,973

[45] Feb. 15, 1983

[54] METHOD OF MANUFACTURE OF HIGH PERFORMANCE GEARS

[75] Inventors: Raymond A. Cellitti, Hinsdale, Ill.; John A. Halgren, Hilltop Lakes, Tex.

[73] Assignee: International Harvester Co., Chicago, Ill.

[21] Appl. No.: 321,515

[22] Filed: Nov. 16, 1981

[51] Int. Cl.[3] ..... C21D 9/32

[52] U.S. Cl. ..... 148/12.4; 148/12.1

[58] Field of Search ..... 148/12.1, 12.4

[56] References Cited

U.S. PATENT DOCUMENTS 2,365,956 12/1944 Hodge et al. ..... 148/12.1
2,860,077 11/1958 Adair et al. ..... 148/12.4
4,119,443 10/1978 Abe et al. ..... 148/12.1
4,210,468 7/1980 McGee ..... 148/12.4

*Primary Examiner*—W. Stallard
*Attorney, Agent, or Firm*—John P. O'Brien; F. David AuBuchon

[57] ABSTRACT

A method for forming gear teeth of a high performance gear is accomplished by shaping the carburized gear tooth surface while the gear blank is held at a uniform temperature in the metastable austenitic condition above the start of the martensitic transformation temperature of the carburized case and then allowed to air cool so that the gear tooth surface will be transformed into very fine grain martensite.

7 Claims, 2 Drawing Figures

METHOD OF MANUFACTURE OF HIGH PERFORMANCE GEARS

BACKGROUND OF THE INVENTION

This invention relates to an improved manufacturing method for enhancing the reliability of high performance gears. In particular, this invention relates to an improvement over the conventional manufacture of high strength gears that requires an expensive finish grind operation of the teeth of the gear.

The conventional manufacture of high strength gears entails a finish grinding operation to provide specified dimensions for proper meshing and the desired loading pattern. Because the contact or mating surfaces of high strength gears require a very hard structure for wear and fatigue resistance, the primary metal cutting method capable of performing the operation is grinding for high performance gears. Many impairments (grinding damage) in surface quality are inherent with surface grinding methods. These impairments include localized burning, structural transformation (untempered and tempered martensite) grinding cracks and removal of beneficial surface constituents and detrimental residual stresses, all of which reduces the pitting fatigue strength or surface durability of the gears.

One object of this invention is to provide a process for manufacturing a higher quality and more reliable gear at a lower cost.

Another object of this invention is to provide an improved method for manufacturing gears that eliminates grinding operations with attendant surface deterioration.

SUMMARY OF THE INVENTION

The principle of this invention is to shape the carburized gear tooth surface of a hobbed gear blank while in the austenitic condition at a uniform temperature range just above the start of the martensitic transformation temperature for the carburized case. The shaping of the carburized gear tooth in the austenitic condition is accomplished by swage rolling a master gear-rolling die tooth across the involute tooth surface in a manner to cause the surface metal of the hobbed gear tooth to flow to conform to the gear-rolling die teeth involute and lead. In addition it greatly improves the topography of the surface and microstructure of the case as far as grain size and strength of the transformed case.

DESCRIPTION OF DRAWINGS

For a better understanding of this invention, reference may be made to the accompanying drawing which is a time-temperature chart for 3310 carburized nickel-chromium steel, identified as FIG. 1.

DESCRIPTION OF THE PREFERRED EMBODIMENT

Figure 1:
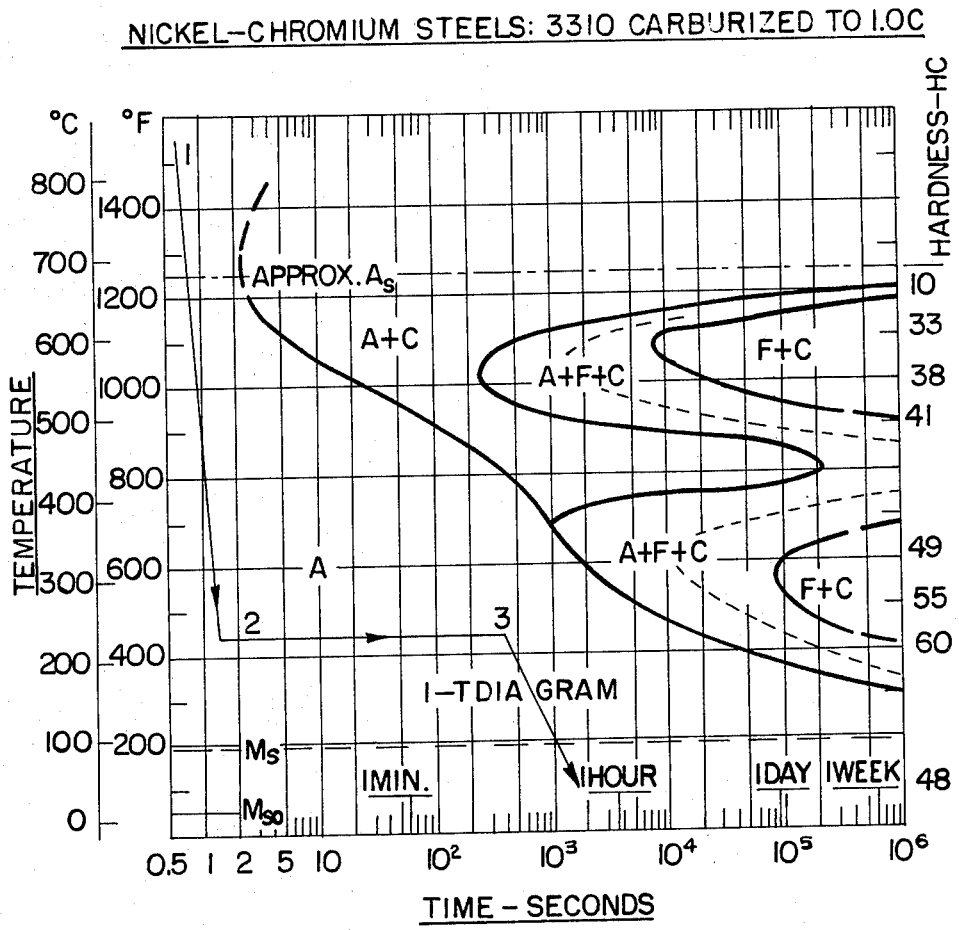

High strength gears are generally fabricated from a low carbon alloy carburizing steel grade in which the surface and sub-surface regions have been enriched with carbon to a specified depth. The higher carbon content serves to increase the hardness and to strengthen the material along the gear contacting teeth surfaces and beneath the surface.

The elevation in hardness results from transformation to a tetragonal very fine grain crystalline structure of the steel from austenite to martensite or isothermal transformation to bainite with hard metallic compounds of iron carbide contained in a martensite matrix upon quenching.

In a conventional gear processing method the hobbed gear blank is quenched rapidly through the austenitic region by immersion of the gear blank into warm oil above the $M_s$ temperature. The hobbed blank is held at this temperature until the gear reaches the $M_s$ temperature whereupon the gear is air cooled to transformed martensite. The term for this process is marquench which results in a structure that is martensite. The hobbed blank is subsequently tempered at a designated temperature to soften the structure and impart ductility. After the tempering treatment is complete, gear finishing is accomplished by grinding in a well known manner for high performance gears. This invention eliminates the grinding operation to provide a microstructurally improved gear tooth surface as will now be described.

There is shown in the drawing (FIG. 1), the time-temperature transformation chart for the 3310 nickel-chromium steel carburized to circa 1.0% surface carbon. The 3310 carburized steel is commonly used for manufacturing high performance gears in the aerospace industry.

The time-temperature transformation curves show the times required for austenite to start and to complete transformation at each temperature. Temperature is shown along the y ordinate and time on a logarithmic scale is shown along the abscissa.

After the 3310 carburized gear is heated above its critical temperature to render it austenitic, it is rapidly isothermally quenched (marquenched) at a rate exceeding a critical cooling rate as represented by line 1–2 on the chart in FIG. 1, in a medium which is just above the temperature at which martensite starts to form and metastable austenite is obtained. Critical cooling rate is defined by the slope of line 1–2 that avoids the nose of the transformation curve where pearlite and/or bainite starts to form.

An important part of this invention is to select a carburizing grade steel, such as carburized/nickel-chromium steel 3310, that has a transformation curve with a metastable austenitic condition just above the martensitic range for a period of time sufficiently long to allow shaping of the gear teeth surfaces. The example given in FIG. 1 shows the metastable austenitic condition (line 2–3) will exist for over sixty minutes in a carburized condition of 0.8 to 1% carbon.

To allow the maximum time for rolling while in the metastable austenitic condition, the cooling should be made just above the martensitic condition. In FIG. 1, the line 2–3 is shown at circa 450° F.

Figure 2:
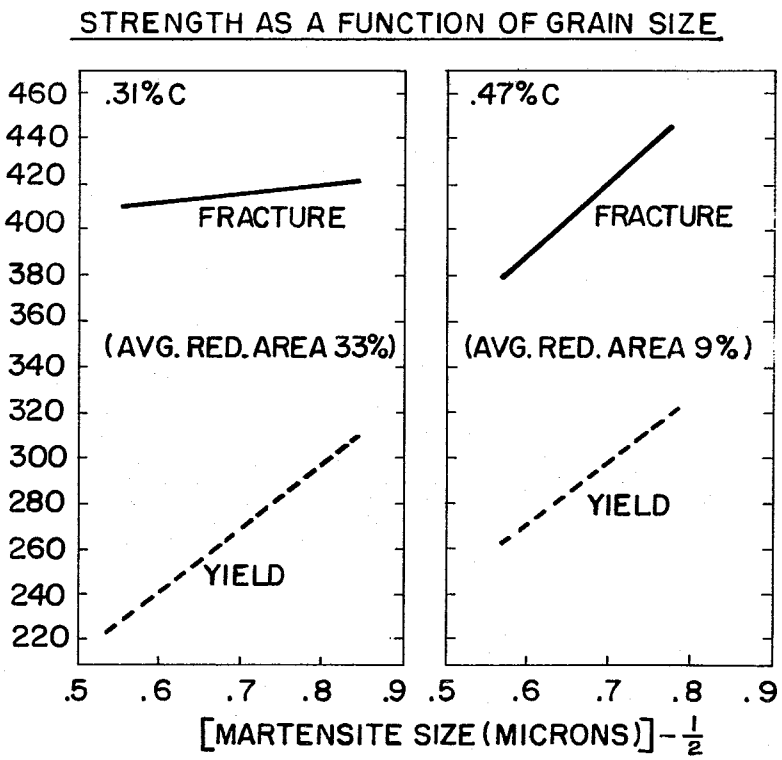

Shaping of gear teeth further in accordance with this invention employs a process whereby gear swaging/rolling is used to shape the gear teeth by deforming the metastable austenite carburized layer prior to and before its conversion to martensite during a pre-transformation time interval at a temperature below that for recrystallization of austenite and just above the $M_s$ of the carburized layer. This process presents a means of developing ultra high strength in the current carburized case hardened gears processed by the conventional heat treat processing. This is shown in FIG. 2 where it shows that the fracture and yield strength increases as the grain size gets smaller. This follows the fundamental understanding of the relation between grain size and mechanical properties which has been empirically observed and then given theoretical substantiation. It is known that the yield and fracture strength of variety of crystalline solids are related to the inverse square root of the grain size of martensite and bainite transformed crystal structure. The martensite grain size is inversely proportional to the degree of austenite deformation.

The shaping by warm working of the metastable austenite at a temperature too low for recrystallization and just above the martensitic transformation results in a high dislocation density, which causes a much finer network of carbides on transformation in the martensitic transformed or in the isothermally lower bainite transformed product. The deformed fragmented austenite produces a very fine grain size which has a beneficial crystal structure of transformed martensite or bainite to provide ultra high strength metal properties.

The improved high strength properties exhibited by martensite from the transformation of warm worked metastable austenite, can be explained by the fact of the effective fine grain of the product transformed from the fragmented grain of warm deformed austenite. A single plate of martensite from such deformed austenite cannot extend to nearly as great dimensions as do the plates of martensite from normal undeformed metastable austenite. The martensite plate cannot grow across a warm deformed austenite band without a severe change in direction.

Quenching could be performed by using very fast quenching oil at a temperature circa 450° F., for example. While the gear blank is at the uniform temperature range in the austenitic condition, its gear teeth are shaped into a desired shape as will be described below. Following the shaping operation, the gear is allowed to air cool through the martensitic range of the carburized case or isothermally transformed to lower bainite in an oil bath at circa 450° F. to obtain a surface hardness of approximately RC 59-62. Finally, the finished gear is burnished by gear rolling at room temperature to "cold work" any remaining retained austenite.

The gear is formed with its gear involute tooth thicknes over-sized in width relative to the desired final size, of the order of 0.0015 to 0.0020 inches. The gear blank, quenched at an appropriate quench rate to a metastable austenitic condition, is moved into a gear roll/swaging meshing relationship with a gear rolling die that is immersed in oil at the same temperature.

The gear rolling die preferably has an inwardly tapered end at the side first engaged by the gear blank to assist in meshing the die and blank together and to swage each tooth causing approximately 0.001 inches metal to be displaced from each tooth. Following this swaging action, the work piece continues rotation in mesh with the roll die and at a select time is radially forced against the roll die at a controlled loading rate which directs the flow of displaced metal along the involute tooth surface. It is preferred that this loading be incrementally increased to cause the displaced metal to accommodate the flow stress material properties to form a crown shape tooth and produce a very smooth surface finish.

The gear blank is formed with its gear teeth approximately 0.001 inches oversized after swaging in tooth thickness relative to the final size so that the gear can meet the dimensional tolerances of AGMA required for high performance gears without the necessity of grinding. The displacement of the metal during the rolling operation after swaging is approximately 0.001 inches. Because grinding is eliminated, there can be as much as a 70% increase in surface durability at any given contact stress level.

As will be appreciated from the foregoing description, the heart of this invention is shaping the carburized gear tooth surface while in a metastable austenitic condition just above the start of the martensitic transformation temperature of the carburized case. By practicing the process of this invention, the physical condition of the gear tooth surface is improved due to a reduction of peak-to-valley roughness for a smoother surface and maintaining a hydrodynamic lubricant film under heavy loads. Furthermore, the gear teeth surfaces have an improved metallurgical microstructure and improved retention of lubrication on teeth contact surfaces to maintain a hydrodynamic film between the gear teeth surfaces. The resulting gear teeth surfaces have superior contact fatigue strength and longer service life with greater reliability than those produced by grinding involute profile surface processes.

What is claimed is:

1. Method of shaping gear teeth of a high performance gear, comprising the steps of:

(a) heating a hobbed gear blank having carburized gear teeth surfaces above its critical temperature to obtain a metastable austenitic structure throughout its carburized case;

(b) isothermally quenching said gear blank at a rate greater than the critical cooling rate of its carburized case to a uniform metastable austenitic temperature just above the martensitic temperature transformation;

(c) holding the temperature of said gear blank in said uniform temperature range while rolling said gear teeth surfaces to a desired shape before martensitic transformation occurs; and (d) cooling said gear through the martensitic range for the carburized gear surfaces to harden said gear surfaces.

2. The method of claim 1, further comprising the final finishing steps of lightly cold working said gear teeth surfaces at room temperature.

3. The method of claim 1, wherein said quenching step is performed in an oil bath maintained at approximately 450° F.

4. Method of shaping gear teeth of a high performance gear, comprising the steps of:

(a) heating a hobbed gear blank having carburized gear teeth surfaces above its critical temperature to obtain a metastable austenitic structure throughout its carburized case, said teeth being approximately 0.002 inches oversized in width to the desired final teeth size;

(b) quenching said gear blank at the cooling rate of its carburized case to a uniform austenitic temperature above the temperature of martensite formation;

(c) holding the temperature of said gear blank in said uniform temperature range while rolling said gear teeth surfaces to a desired shape before martensitic transformation occurs, where the displacement of metal is approximately 0.001 to 0.002 inches; and (d) cooling said gear through the martensitic range for the carburized gear surfaces to harden said gear surfaces.

5. The method of claim 4, further comprising the final finishing step of lightly cold working said gear teeth surfaces at room temperature.

6. The method of claim 4, wherein said quenching step is performed in an oil bath maintained at approximately 450° F.

7. The method of claim 4, wherein said step of rolling said gear teeth surfaces while at a uniform austenitic temperature comprises:

(a) swaging the crown portion of each gear tooth to displace 0.001 to 0.002 inches of metal; and (b) increasingly incrementally loading in an inwardly radial direction the lateral faces of each gear tooth to displace metal to the valley portion between adjacent teeth to form a crown-shaped surface.

* * * * *